US008917893B2

(12) United States Patent
Peters et al.

(10) Patent No.: US 8,917,893 B2
(45) Date of Patent: Dec. 23, 2014

(54) HEARING AID

(75) Inventors: Roderik Paul Bernard Eduard Marie Peters, Amsterdam (NL); Randall Carey Dillon, Heerhugowaard (NL)

(73) Assignee: ExSilent Research B.V., Amsterdam (NL)

( * ) Notice: Subject to any disclaimer, the term of this patent is extended or adjusted under 35 U.S.C. 154(b) by 75 days.

(21) Appl. No.: 13/502,785

(22) PCT Filed: Oct. 18, 2010

(86) PCT No.: PCT/NL2010/050688

§ 371 (c)(1),
(2), (4) Date: Jun. 18, 2012

(87) PCT Pub. No.: WO2011/049437

PCT Pub. Date: Apr. 28, 2011

(65) Prior Publication Data

US 2012/0250922 A1 Oct. 4, 2012

(30) Foreign Application Priority Data

Oct. 19, 2009 (NL) ..... 2003672

(51) Int. Cl.
*H04R 25/00* (2006.01)

(52) U.S. Cl.
CPC ..... *H04R 25/602* (2013.01); *H04R 2225/61* (2013.01); *H04R 2460/11* (2013.01); *H04R 25/65* (2013.01); *H04R 25/556* (2013.01)
USPC ..... 381/323; 381/314; 381/322; 381/324; 381/328; 381/329

(58) Field of Classification Search
CPC .... H04R 25/556; H04R 25/65; H04R 25/602; H04R 2460/11; H04R 2225/61
USPC ..... 381/314, 322–324, 328, 329
See application file for complete search history.

(56) References Cited

U.S. PATENT DOCUMENTS 4,961,230 A * 10/1990 Rising ..... 381/323
6,319,020 B1 * 11/2001 Brimhall et al. ..... 439/77

(Continued)

FOREIGN PATENT DOCUMENTS

DE 10 2007 037877 1/2009
WO 01/43499 6/2001

(Continued)

OTHER PUBLICATIONS

International Search Report dated Mar. 4, 2011, corresponding to PCT/NL2010/050688.

*Primary Examiner* — Curtis Kuntz
*Assistant Examiner* — Joshua A Kaufman
(74) *Attorney, Agent, or Firm* — Young & Thompson

(57) ABSTRACT

A hearing aid includes a device housing (2) in which a programmable sound processing device is received on a carrier. The carrier is provided on a main surface with a conductor track which lies exposed in an opening (8) in an outer casing of the device housing (2). A coupling connector (20) of an external programming device can be received in the opening in order to place the conductor track on the main surface of the carrier into direct and operative contact with a corresponding conductor track on the coupling connector. A separate connector for the purpose of programming and tuning the sound processing device to the individual hearing characteristics and/or wishes of a user can thus be omitted from the hearing aid.

68 Claims, 5 Drawing Sheets

(56) References Cited

U.S. PATENT DOCUMENTS

Figure 1A:
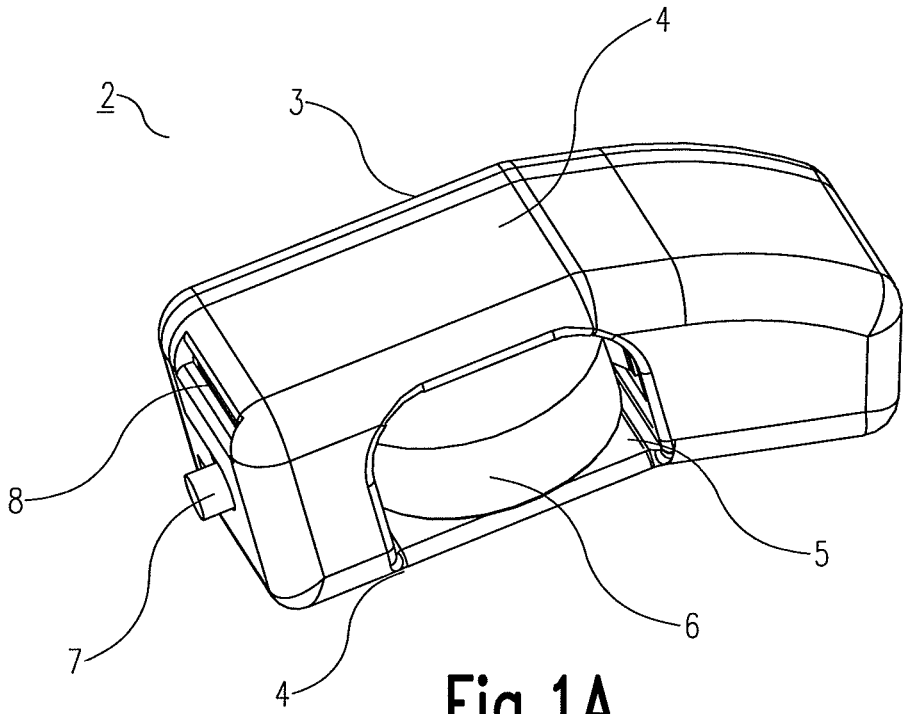

| | | | | |
|---|---|---|---|---|
| 6,456,720 | B1 * | 9/2002 | Brimhall et al. | 381/324 |
| 6,516,074 | B1 * | 2/2003 | Brimhall et al. | 381/322 |
| 2004/0052390 | A1 | 3/2004 | Morales et al. | |
| 2004/0062409 | A1 * | 4/2004 | Batting | 381/323 |
| 2004/0240695 | A1 | 12/2004 | Leedom et al. | |
| 2006/0078142 | A1 | 4/2006 | Neilson | |
| 2007/0177749 | A1 | 8/2007 | Sjursen et al. | |
| 2009/0316940 | A1 * | 12/2009 | Pander et al. | 381/323 |

FOREIGN PATENT DOCUMENTS

| | | |
|---|---|---|
| WO | 02/34010 | 4/2002 |
| WO | 2006/121334 | 11/2006 |
| WO | 2007/069889 | 6/2007 |

* cited by examiner

HEARING AID

BACKGROUND OF THE INVENTION

The present invention relates to a hearing aid comprising a device housing in which a programmable sound processing device is received, which sound processing device is arranged on a carrier provided on a main surface with at least one conductor track, and which sound processing device comprises an electronic port for data exchange, which port can be coupled at least via the at least one conductor track to a coupling connector of an external programming device.

DESCRIPTION OF THE RELATED ART

Such a hearing aid is for instance known from the international patent application WO 2007/069889 of applicant. The hearing aid described therein comprises a device housing in which a programmable sound processing device is arranged an a relatively flexible printed circuit board. For optimum operation of the hearing aid the sound processing device can be individually programmed and tuned to the individual hearing characteristics and/or wishes of a user. In the case of the known hearing aid this involves the device housing comprising a hollow bus on a proximal side as electronic port into which a male coupling connector of an external programming device can be inserted to enable mutual data exchange. By coupling of the coupling connector of the external programming device to the electronic port the known hearing aid can be programmed in relatively simple manner for tuning thereof to the individual hearing characteristics and/or wishes of the user. The hollow bus does however form an additional component of the hearing aid so that the design, size and other features of the device housing are also dependent thereon.

SUMMARY OF THE INVENTION

The present invention therefore has for its object, among others, to provide a hearing aid of the type stated in the first paragraph which can be modified electronically with a simpler device housing.

In order to achieve the stated objective a hearing aid of the type stated in the first paragraph has the feature according to the invention that the device housing comprises in an outer casing an opening which leaves the at least one conductor track at least locally exposed, and that the coupling connector can be received at the position of the opening, wherein the at least one conductor track on the main surface of the carrier is in operative contact with a corresponding conductor track on the coupling connector. Because the at least one conductor track connects in directly operative manner to the corresponding conductor track of the coupling connector, a separate connector component is not necessary for this purpose in the device housing. For the adjustable hearing aid use can thus be made of a simple device housing which has a compact size and can be produced at relatively low cost.

In a preferred embodiment the hearing aid according to the present invention is characterized in that the opening comprises a recess in the outer casing and that the carrier lies with an exposed part of the at least one conductor track in the recess. The recess with which the coupling connector of the external programming device can mate provides for an automatic guiding of the coupling connector so that the corresponding conductor track of the coupling connector connects for reliable operation to the at least one conductor track lying in the recess. The recess in the outer casing moreover represents a further space-saving measure giving the device housing an even more compact size. In an alternative preferred embodiment the hearing aid according to the present invention is characterized in that the opening comprises a gap in the outer casing behind which lies the carrier with the at least one conductor track, and that at least a part of the at least one conductor track is accessible by the coupling connector via the gap.

In a further preferred embodiment the hearing aid according to the invention has the feature that the device housing comprises coupling means which are able and adapted to couple the coupling connector with the corresponding conductor track releasably to the at least one conductor track of the carrier. This prevents the possibility of the external programming device, after coupling to the at least one conductor track, undesirably coming loose, thereby aborting a programming step.

In a particular embodiment the hearing aid according to the present invention is characterized in that the device housing is held in at least substantially fitting manner in a fitting body with a relatively flexible, limp outer wall able and adapted to adjust itself to a natural anatomy of an auditory canal of a user so as to lie close-fittingly therein. The hearing aid thus forms a modular system with a compact device housing which can be placed deep into an auditory canal of a user and a fitting body which wholly seals the auditory canal acoustically when placed therein so as to prevent possible acoustic feedback.

In a further particular embodiment the hearing aid according to the present invention has the feature that the fitting body connects at least substantially closely onto the device housing, and that at the position of the opening in the device housing there is a freely accessible space between the fitting body and the device housing for receiving the coupling connector therein in actively clamping manner. The corresponding conductor track of the coupling connector is thus secured operatively to the at least one conductor track by the clamping between the fitting body and the device housing. Additional coupling means are no longer necessary for this purpose.

In order to enable problem-free removal of the hearing aid from the ear when desired, a further embodiment of the hearing aid according to the invention has the feature that the fitting body comprises an engaging member extending beyond a proximal side of the device housing. The hearing aid can thus be grasped by the engaging member on the proximal side and thereby pulled in its entirety out of the ear.

In a further preferred embodiment the hearing aid according to the present invention has the feature that at least the engaging member is provided with a recess intended for receiving therein at least an outer end of the coupling connector on which the corresponding conductor track is provided and for guiding it to the opening of the device housing. The recess thus imparts a correct orientation to the corresponding conductor track for an operative contact on the at least one conductor track in the hearing aid.

In order to prevent occlusion phenomena occurring in the auditory canal because of the substantially tight sealing of the auditory canal by the fitting body, the hearing aid according to the present invention is characterized in a further preferred embodiment in that the fitting body comprises in the outer wall thereof at least one continuous open ventilating channel which opens on a proximal side into a proximal ventilating opening and on a distal side into a distal ventilating opening, and that the device housing is arranged between the proximal ventilating opening and the distal ventilating opening in the fitting body. The hearing aid thus allows an exchange of air between a part of the auditory canal lying distally of the hearing aid and a part of the auditory canal lying proximally of the hearing aid, so preventing the occlusion phenomena usually perceived as irritating.

In a particular embodiment the hearing aid according to the present invention has the feature that a relatively rigid tubular body is received in the at least one ventilating channel which is able and adapted to hold the ventilating channel open. This prevents the ventilating channel being pressed shut when the hearing aid is placed in an auditory canal of a user.

For a realistic reproduction of ambient sound that is as reliable as possible, and in particular a directional sensitivity of the hearing aid, particularly a microphone of a hearing aid must in practice be arranged as deeply as possible in an auditory canal of a user. The known hearing aid comprises for this purpose a device housing which is bounded by a casing and which comprises a component layer with a microphone, a loudspeaker and a sound processing device on a proximal side and a battery chamber on a distal side. A battery received in the battery chamber extends distally from the loudspeaker above a transmission channel with which the loudspeaker is in open communication with a sound output on a distal side of the device housing. The transmission channel is acoustically separated here from the microphone. The known hearing aid is hereby particularly equipped to be placed wholly in an auditory canal of a user and herein prevent so-called acoustic feedback, wherein sound emitted by the loudspeaker is picked up by the microphone and then, amplified or processed, once again generated via the loudspeaker and picked up again by the microphone, and so on.

The known device housing can be placed in an auditory canal of the user such that the device is practically invisible from outside. Because of a disposition of the components in the component layer the device housing of this known hearing aid does however have a size which for most users does not readily enable a deeper placing of the known device housing in the auditory canal which would enhance the acoustics.

In a further respect the present invention has the further object, among others, of providing a hearing aid which can be inserted deeply into an auditory canal of a user in relatively simple manner.

For this purpose the present invention also provides a hearing aid which is adapted to be received at least almost wholly in an auditory canal of a user in locally fitting manner, comprising inside a device housing a microphone, a loudspeaker, a battery chamber and a programmable sound processing device which is able to generate an optionally processed sound signal from the microphone to the loudspeaker, and which is characterized for this purpose according to the invention in that the device housing is at least partially bounded between the proximal side and the distal side by an outer casing comprising at least two opposite, at least substantially parallel, substantially flat casing parts for bounding a substantially block-shaped space therebetween, that the group of electronic components comprises a thickest component and a widest component, that a thickness of the substantially block-shaped space between the two casing parts is at least substantially equal to a thickness of the thickest component, and that a width of the substantially block-shaped space is at least substantially equal to a width of the widest component. A further reduction in the size of the device housing is thus only possible by reducing the size of the components applied in the device housing. Because the flat casing parts bound a space which is as thick as the thickest component and as wide as the widest component, a distance between the casing parts is substantially minimal for a given thickness of the thickest component and a given width of the widest component. The device housing is hereby exceptionally compact. The hearing aid can hereby be arranged relatively deeply into an auditory canal of a user.

In a preferred embodiment the hearing aid according to the present invention is characterized in that the thickest and widest component is the battery which lies fittingly in a battery chamber, and that other components are situated fitting between the casing parts on one side of the battery chamber. Because the battery chamber is thus bounded on only one side by the other components, instead of on multiple sides, another side of the battery chamber can be kept clear or made clear in simple manner. The battery chamber is hereby readily accessible, for instance in order to simplify placing of the battery in the compact device housing.

In a further preferred embodiment the hearing aid according to the present invention has the feature that the battery chamber lies on the proximal side of the device housing between the casing parts and that the other components are situated distally of the battery chamber between the casing parts. The other components, and in particular the microphone and loudspeaker, thus lie deeper in the auditory canal when the device housing is placed. Such a deeper position of the microphone and loudspeaker in the auditory canal improves the acoustic properties of the hearing aid, particularly in respect of the directional sensitivity thereof.

For exceptionally easy placing of the device housing in the auditory canal of a user the hearing aid according to the present invention is characterized in a further preferred embodiment in that the device housing is at least substantially flat in a thickness direction, and that the outer casing is curved from the distal side to the proximal side in the thickness direction at an angle of between 10-20 degrees, in particular between 14-16 degrees, and the hearing aid according to the present invention is characterized in a particular embodiment hereof in that the casing parts curve from the distal side to the proximal side in the thickness direction at an angle of between 10-20 degrees, in particular between 14-16 degrees. Although the auditory canals of people can differ greatly from one another, it is the case for many people that their auditory canal, from the opening on the outer ear side to an outer end on the inner ear side, describes an angle of between 10 and 20 degrees. By making use of a flat hearing aid in which the device housing describes substantially the same angle, the design is optimally adapted to an auditory canal of a user in order to easily enable deep placing thereof.

In order to enable actual tuning of a hearing aid programmed by means of the external programming device to the individual hearing characteristics and/or wishes of the user, a hearing aid requires at least a control key to enable selection therewith of a processing characteristic in the sound processing device. The known hearing aid comprises for this purpose on a proximal side of the device housing a push-button which can be pressed manually relative to another part of the device housing in order to change a switch mode with which the sound processing device is controlled.

Although the push-button functions well as control key for controlling a hearing aid, this button forms an additional component which influences the overall size of the device housing. In yet another respect the present invention has for its object to provide a hearing aid with an exceptionally compact device housing.

For this purpose the present invention also provides a hearing aid which comprises a device housing which provides space for at least a control switch and a group of electronic components, the group comprising at least a loudspeaker, a microphone, a sound processing device, a programming connector, a battery and the control switch, and which is characterized for this purpose according to the invention in that the device housing comprises at least two parts axially adjustable relative to each other, that between said parts are provided spring means which exert a bias between the two parts, that the parts are compressible counter to the bias from an initial state to a compression state, and that both parts are provided with switch contacts of the control switch which touch each other during a transition of the parts between the initial state and the compression state, whereby the control switch enters a changed switch mode. By thus imparting a so-called push-button functionality to parts or components of the device housing itself, a separate push-button for this purpose can be dispensed with. This results in a space-saving which allows a miniaturization of the device housing.

In a particularly practical embodiment the hearing aid according to the present invention is however characterized in that one of the parts comprises the battery which is arranged movably inside a battery chamber, and that in the compression state the battery makes contact with a switch contact arranged against a wall of the battery chamber.

In order to prevent the possible occurrence of acoustic feedback effects in the auditory canal a hearing aid, when placed in the auditory canal of the user, must completely seal the auditory canal acoustically between at least a microphone and a loudspeaker of the hearing aid. The known hearing aid comprises for this purpose a device housing which can be placed substantially wholly in a fitting body with a relatively flexible, limp wall which is able and adapted to adjust itself to a natural anatomy of the auditory canal in order to lie close-fittingly therein. The known hearing aid thus forms a modular system with a device housing which can be placed in an auditory canal of a user and a fitting body which wholly seals the auditory canal acoustically when placed therein in order to prevent possible acoustic feedback effects. Although the fitting body of the known hearing aid effectively prevents acoustic feedback, it is found that occlusion phenomena occur in the auditory canal because of the substantially tight sealing of the auditory canal by the fitting body.

In yet another respect the present invention has for its object to provide a hearing aid which prevents occlusion phenomena.

The present invention also provides for this purpose a hearing aid intended and adapted to be received at least almost wholly inside an auditory canal of a user in locally fitting manner, comprising a substantially rigid, form-retaining device housing in which at least one component is provided from a group of components, the group comprising a microphone, a loudspeaker, a sound processing device and a battery, wherein the device housing is held in at least substantially fitting manner in a fitting body with a relatively flexible, limp wall which is able and adapted to adjust itself to a natural anatomy of an auditory canal so as to lie close-fittingly therein, which is characterized for this purpose according to the invention in that the fitting body comprises in the wall thereof at least one continuous open ventilating channel which opens on a proximal side into a proximal ventilating opening and on a distal side into a distal ventilating opening, and that the device housing is arranged between the proximal ventilating opening and the distal ventilating opening in the fitting body. The hearing aid thus allows an exchange of air between a part of the auditory canal lying distally of the hearing aid and a part of the auditory canal lying proximally of the hearing aid. Undesirable occlusion phenomena are hereby prevented.

In a particular embodiment the hearing aid according to the present invention has the feature that a relatively rigid tubular body is received in the ventilating channel. This prevents the air channel being pressed shut when the hearing aid is placed in an auditory canal of a user.

BRIEF DESCRIPTION OF THE DRAWING FIGURES

Figure 1B:
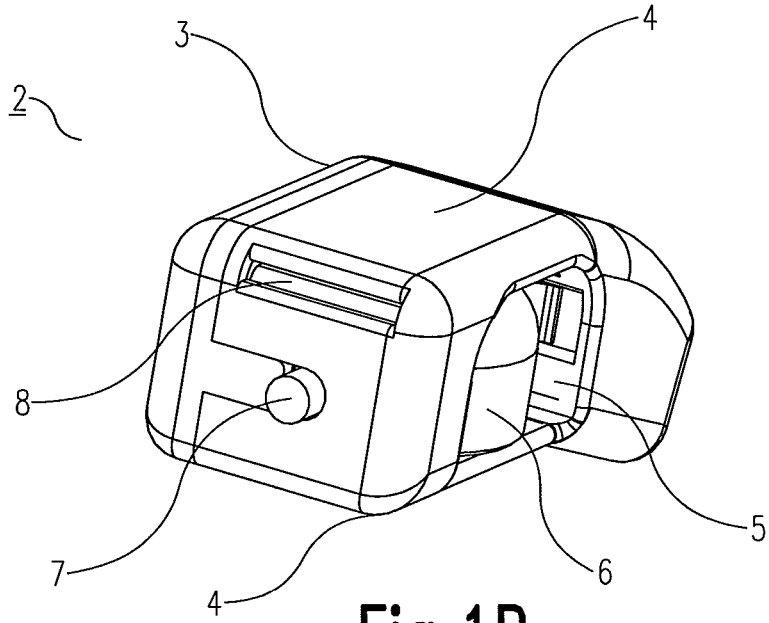

The invention will now be further elucidated on the basis of an exemplary embodiment and an associated drawing. In the drawing:

FIGS. 1A-B show respectively a first perspective view and a second perspective view of an exemplary embodiment of a device housing for application in a hearing aid according to the invention.

Figure 2A:
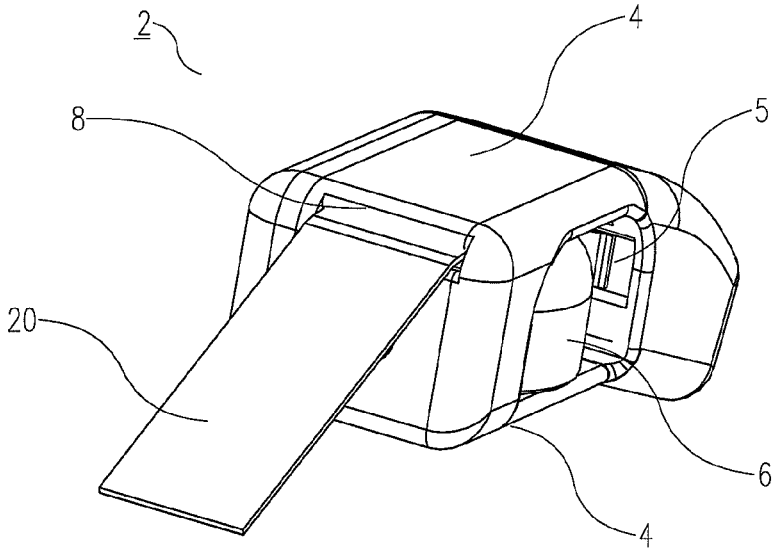
Figure 2B:
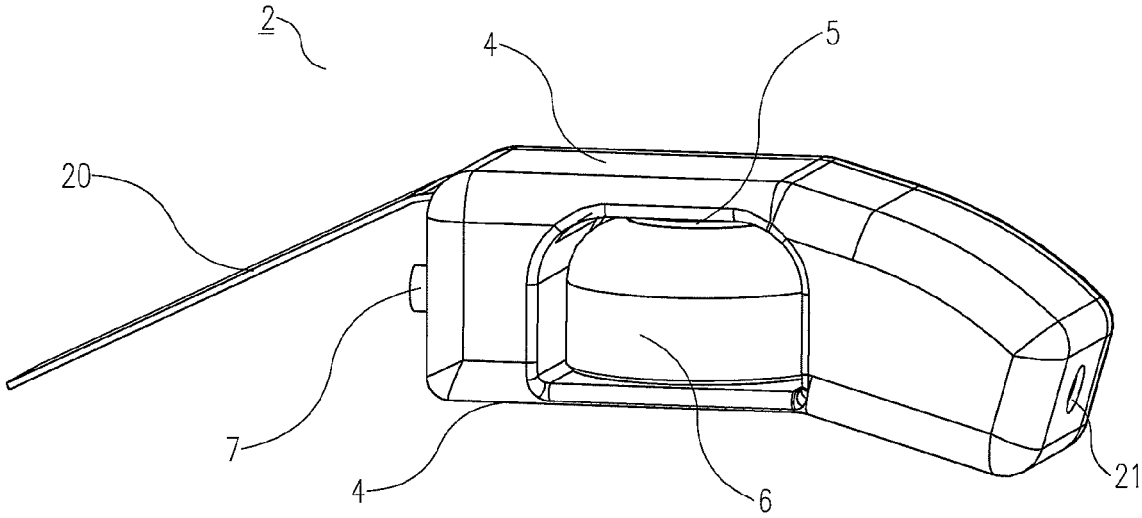

FIGS. 2A-B show respectively a first perspective view and a second perspective view of the exemplary embodiment of a device housing in coupled position with an external programming device for application in a hearing aid according to the invention.

Figure 3A:
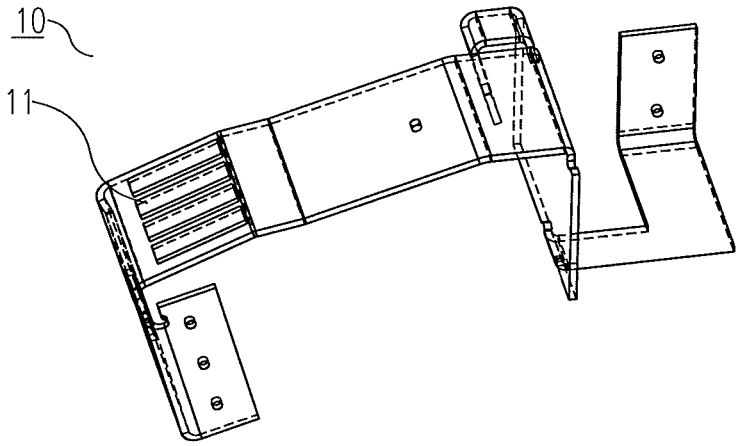
Figure 3B:
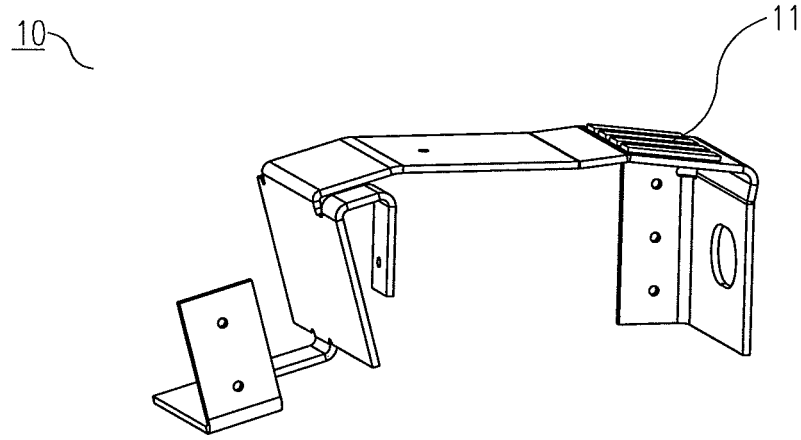

FIGS. 3A-B show respectively a first perspective view and a second perspective view of an exemplary embodiment of a flexible printed circuit board for application in a hearing aid according to the invention.

Figure 4:
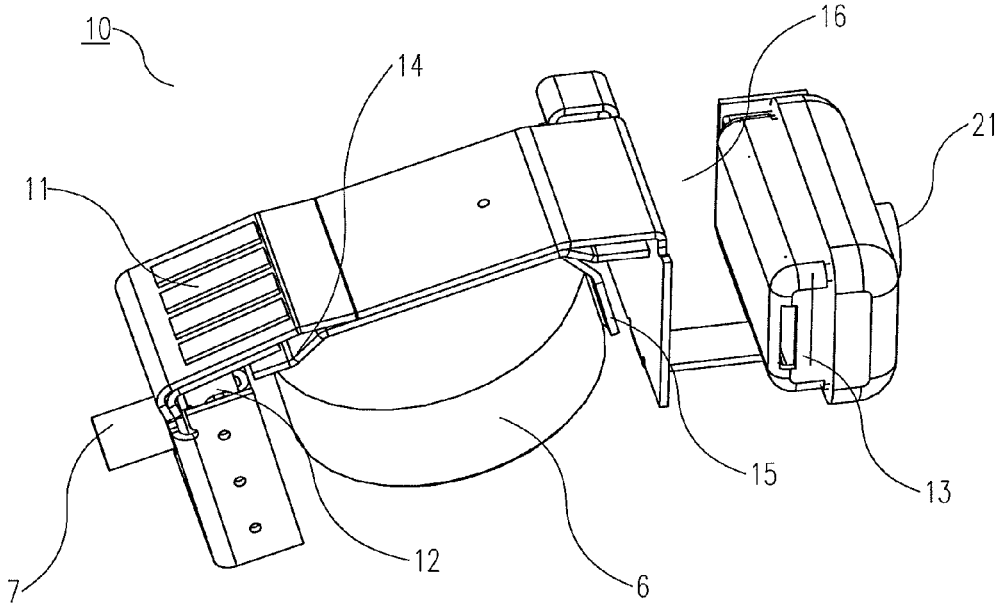

FIG. 4 shows a perspective view of the exemplary embodiment of a flexible printed circuit board with mounted components for application in a hearing aid according to the invention.

Figure 5A:
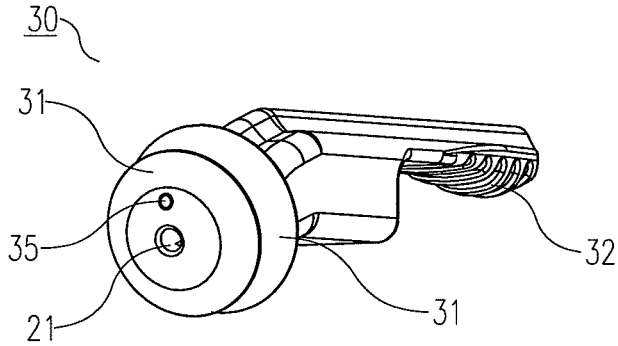
Figure 5B:
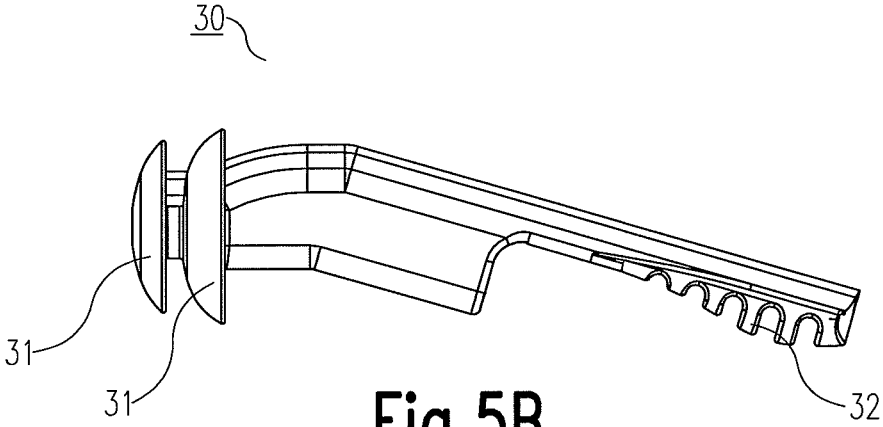
Figure 5C:
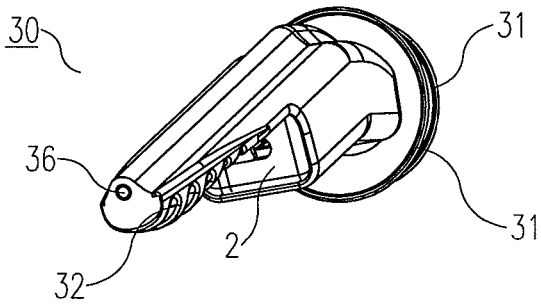

FIGS. 5A-C show respectively a first, second and third perspective view of a fitting body for application in a hearing aid according to the invention.

DETAILED DESCRIPTION OF THE INVENTION

The figures are otherwise purely schematic and not drawn to scale. For the sake of clarity some dimensions in particular may be exaggerated to a greater or lesser extent. Corresponding parts are designated as far as possible in the figures with the same reference numeral.

As shown in FIG. 1A and FIG. 1B in an exemplary embodiment of a device housing for application in a hearing aid according to the invention, device housing 2 comprises a casing 3 with a pair of plan-parallel casing parts 4 at least partially bounding device housing 2. The pair of casing parts 4 enclose a component layer having on a proximal side of device housing 2 a microphone for receiving sound thereon and on a distal side of device housing 2 a loudspeaker for generating sound therewith. Located between the microphone, the loudspeaker and casing parts 4 is a battery chamber 5 which is dimensioned such that a battery 6 lies just fitting therein. Device housing 2 has a thickness and width here substantially the same as a thickness and width of battery 6. The other components of the component layer, including the microphone, loudspeaker and sound processing device, are placed within the plan-parallel casing parts 4 such that device housing 2 has a flat and compact form. The hearing aid can thus be arranged relatively deeply into an auditory canal of a user. Because casing parts 4 have the same curvature here, from the proximal side of the device housing to the distal side of the device housing in the thickness direction of the device housing, as an auditory canal of an average user, i.e. an angle of between 10-20 degrees, in particular between 14-16 degrees, the hearing aid can moreover be placed deeply into the auditory channel in simple manner.

On the proximal side the device housing 2 comprises a control key 7 to enable manual selection therewith of a function on the hearing aid. Control key 7 can thus be for instance a switch serving as on/off switch for respective activation and deactivation of the hearing aid. Control key 7 can however also be one of two parts of the device housing which are compressible counter to a spring tension and which in a compressed position close a circuit. The one part can thus be formed for instance by the battery arranged movably in the battery chamber. By then manually exerting sufficient pressure on the battery from outside, for instance with a finger, to counteract the spring tension the battery in the battery chamber will move and make contact with a battery contact in the battery chamber. A circuit will be closed by this contact, whereby a function in the device housing is activated or deactivated. By thus imparting a so-called push-button functionality to components of the device housing itself, a separate push-button for this purpose can be dispensed with. This results in space-saving which enhances the compact form of the device housing.

In this exemplary embodiment control key 7 is a push-button further enabling a preferred selection to be made in the sound-processing device from a pre-loaded selection of processing characteristics. For the purpose of loading processing characteristics into the sound processing device the device housing 2 is provided on the proximal side with a groove 8 inside which thickened signal tracks 11, see FIG. 3A, of a programming input are left exposed. Signal tracks 11 can be connected for direct operation to complementary signal tracks of a coupling connector of an external programming device in order to enable transfer of processing characteristics stored in the external programming device to the sound processing device.

As further shown in FIG. 2A and FIG. 2B, the external programming device 20 can be arranged with the coupling connector in groove 8 for direct operative connection to signal tracks 11. Using the external programming device 20 or more personal processing characteristics can be loaded into the sound processing device of the hearing aid. The hearing aid can thus be adapted as required to for instance the individual requirements of the user and/or be modified for instance to an ambient sound for the purpose of optimum sound reproduction. The external programming device 20 can be formed by a thin, flexible printed circuit board which can be easily inserted into groove 8. The hearing aid need not here be taken out of the auditory canal of the user, and the sound processing device can thus be tuned as required during use of the hearing aid. Because the signal tracks connect for direct operation to the complementary signal tracks of the external programming device 20, a separate connector component is not necessary for this purpose in the device housing. Because a component is thus dispensed with, the device housing has an exceptionally compact form. As further shown in FIG. 3A and FIG. 3B, signal tracks 11 lie exposed on a carrier 10 on which the components of the component layer can be mounted, see FIG. 4.

As shown in FIG. 4, the components of the component layer of the hearing aid are pre-mounted on a carrier 10 formed by a flexible printed circuit board on which the necessary conductor tracks are provided for mutual connection of the components. Microphone 12 is mounted close to control key 7 on the proximal side. Loudspeaker 13 is arranged on the distal side. A battery 6 is placed lying in a battery chamber between microphone 12 and loudspeaker 13 and herein makes contact with a pair of battery contacts 14,15. Space 16 between battery 6 and loudspeaker 13 provides space for a sound processing device (not shown). The components are thus arranged precisely in a relatively flat component layer and can be tested for correct operation before casing parts 4 are arranged therearound for the purpose of assembling the whole to form a complete device housing 10. During use the microphone 12 on the proximal side picks up sound and transmits this via the battery chamber to a signal input of the sound processing device. The sound processing device amplifies and processes the input signal on the basis of the processing characteristic selected therein by means of control key 7 and generates this as output signal to loudspeaker 13. From loudspeaker 13 the sound signal is carried to sound output 21 of the hearing aid, where it enters the auditory canal and is perceived by the auditory organs of the user in amplified and possibly processed form.

In order to prevent acoustic feedback the device housing 2 is arranged in a flexible fitting body, the form of which adapts itself in use to the auditory canal of the user. Because the auditory canal is in this way wholly sealed acoustically, sound transmitted to the loudspeaker is prevented from possibly leaking along the hearing aid to the microphone. As shown in FIGS. 5A,B,C, the flexible fitting body 30 comprises on a proximal side a tip 32 which extends relative to device housing 2 and which is profiled on an underside so that it can engage properly thereon. The hearing aid can hereby be easily taken out of an auditory canal. On an opposite distal side the fitting body 30 is provided with two concentric flexible rings 31 which, when the hearing aid is placed in an auditory canal, will shape themselves to the precise form of the auditory canal. A sound output 21, to which sound is transmitted from the loudspeaker, is situated distally of the concentric rings so that the released sound cannot leak through between the hearing aid and a wall of the auditory canal to the proximally located microphone. The close fit of rings 31 in the auditory canal moreover prevents the hearing aid being driven out of the auditory canal. Because fitting body 30 at least almost wholly seals the auditory canal, there is a risk of occlusion phenomena occurring. Provided in the flexible fitting body 30 in order to prevent this is an air channel which is open on the distal side with a first opening 35 and opens on the proximal side with a second opening 36. Owing to the air channel the auditory canal will not be sealed completely airtightly, so that occlusion phenomena are countered. In order to prevent possible acoustic feedback the second opening 36 is here removed as far as possible from the microphone input and arranged on the proximal side in tip 32. The air channel is provided with a relatively rigid wall in order to avoid the channel being pressed shut when the flexible fitting body 30 is placed in the auditory canal. The fitting body 30 itself can for this purpose be given a relatively rigid form around the air channel, although in this exemplary embodiment use is made of a relatively rigid tubular element arranged for strengthening purposes in the air channel. Fitting body 30 can hereby be supplied serially as a standard article in a limited number of sizes so as to provide a satisfactory fit for diverse users, while the air passage of the air channel can be adapted to an individual user by selecting the tubular element as required from a selection of tubular elements of mutually varying diameter.

In addition to the sealing action of fitting body 30, wherein acoustic feedback is prevented, fitting body 30 protects against possible damage to the device housing 2 place therein. Fitting body 30 moreover encloses device housing 2 almost completely so that particularly cerumen cannot penetrate into device housing 2. The battery chamber in device housing 2 can hereby be given an open form, without for instance a closing flap body, this on the one hand enhancing ventilation of the battery chamber and on the other allowing an even more compact form of device housing 2. Fitting body 30 leaves clear only a proximal side of device housing 2 with the sound input of the microphone, the control key and groove 8 for the programming input. Close to groove 8 the fitting body 30 is provided with a track with which the external programming device can mate in order to simplify placing thereof in groove 8. Fitting body 30 moreover provides for an additional clamping action here in order to prevent the possibility of undesirable release of the external programming device from groove 8.

Although the invention has been further elucidated with reference to only several exemplary embodiments, it will be apparent that the invention is by no means limited thereto. On the contrary, many more variations and embodiments are possible within the scope of the invention for a person with ordinary skill in the art.

The invention claimed is:

1. Hearing aid comprising a device housing in which a programmable sound processing device is received, which sound processing device is arranged on a carrier provided on a main surface with at least one conductor track, and which sound processing device comprises an electronic port for data exchange, which port can be coupled at least via the at least one conductor track to a coupling connector of an external programming device, characterized in that the device housing comprises in an outer casing an opening which during use of the hearing aid in an auditory canal of a user leaves the at least one conductor track at least locally exposed, and that the coupling connector can be received at the position of the opening, wherein the at least one conductor track on the main surface of the carrier is in operative contact with a corresponding conductor track on the coupling connector, wherein the opening in the outer casing and a conductor track freely exposed behind the opening constitute the electronic port.

2. Hearing aid as claimed in claim 1, characterized in that the opening comprises a recess in the outer casing and that the carrier lies with an exposed part of the at least one conductor track in the recess.

3. Hearing aid as claimed in claim 1, characterized in that the opening comprises a gap in the outer casing behind which lies the carrier with the at least one conductor track, and that at least a part of the at least one conductor track is accessible by the coupling connector via the gap.

4. Hearing aid as claimed in claim 1, characterized in that the device housing is held in at least substantially fitting manner in a fitting body with a relatively flexible, limp outer wall able and adapted to adjust itself to a natural anatomy of an auditory canal of a user so as to lie close-fittingly therein.

5. Hearing aid as claimed in claim 4, characterized in that the fitting body connects at least substantially closely onto the device housing, and that at the position of the opening in the device housing there is a freely accessible space between the fitting body and the device housing for receiving the coupling connector therein in actively clamping manner.

6. Hearing aid as claimed in claim 4, characterized in that the fitting body comprises an engaging member extending beyond a proximal side of the device housing.

7. Hearing aid as claimed in claim 6, characterized in that at least the engaging member is provided with a recess intended for receiving therein at least an outer end of the coupling connector on which the corresponding conductor track is provided and for guiding it to the opening of the device housing.

8. Hearing aid as claimed in claim 4, characterized in that the fitting body comprises in the outer wall thereof at least one continuous open ventilating channel which opens on a proximal side into a proximal ventilating opening and on a distal side into a distal ventilating opening, and that the device housing is arranged between the proximal ventilating opening and the distal ventilating opening in the fitting body.

9. Hearing aid as claimed in claim 8, characterized in that a relatively rigid tubular body is received in the at least one ventilating channel which is able and adapted to hold the ventilating channel open.

10. Hearing aid as claimed in claim 1, characterized in that the outer casing encloses between a proximal side and a distal side of the device housing a group of electronic components comprising at least a microphone, a loudspeaker, a battery and the sound processing device, that the outer casing comprises at least two opposite, at least substantially parallel, substantially flat casing parts for bounding a substantially block-shaped space therebetween, that the group of electronic components comprises a thickest component and a widest component, that a thickness of the block-shaped space between the two casing parts is at least substantially equal to a thickness of the thickest component, and that a width of the block-shaped space is at least substantially equal to a width of the widest component.

11. Hearing aid as claimed in claim 10, characterized in that the battery is the thickest and widest component and that the other components are situated fitting between the casing parts on one side of the battery.

12. Hearing aid as claimed in claim 11, characterized in that the battery lies on the proximal side of the device housing in a battery chamber between the casing parts and that the other components are situated distally of the battery chamber between the casing parts.

13. Hearing aid as claimed in claim 10, characterized in that the device housing is at least substantially flat in a thickness direction, and that the outer casing is curved from the distal side to the proximal side in the thickness direction at an angle of between 10-20 degrees, in particular between 14-16 degrees.

14. Hearing aid as claimed in claim 13, characterized in that the casing parts curve from the distal side to the proximal side in the thickness direction at an angle of between 10-20 degrees, in particular between 14-16 degrees.

15. Hearing aid as claimed in claim 1, characterized in that the device housing comprises a control switch and at least two parts axially adjustable relative to each other, that between said parts are provided spring means which exert a bias between the two parts, that the parts are compressible counter to the bias from an initial state to a compression state, and that both parts are provided with switch contacts of the control switch which touch each other during a transition of the parts between the initial state and the compression state, whereby the control switch enters a changed switch mode.

16. Hearing aid as claimed in claim 15, characterized in that one of the parts comprises a battery which is arranged movably inside a battery chamber, that one of the switch contacts makes contact with the battery and that in the compression state the battery makes contact with a further switch contact arranged against a wall of the battery chamber.

17. Hearing aid as claimed in claim 1, wherein, the opening in the outer casing is formed by a groove in the outer casing, and the electronic port, via which the coupling connector, functionally couples to the sound processing device.

18. Hearing aid as claimed in claim 17, wherein, the device housing comprises coupling means which are able and adapted to couple the coupling connector with the corresponding conductor track releasably to the at least one conductor track of the carrier, the coupling connector fits in the groove such that the coupling connector is prevented from coming loose after coupling, and edges of the device housing define the groove and are operative as the coupling means to provide a releasable coupling of the connector to the conductor track of the carrier.

19. Hearing aid intended and adapted to be received at least substantially completely in an auditory canal of a user in locally fitting manner, comprising a device housing with a group of electronic components between a sound input on a proximal side and sound output on a distal side comprising at least a microphone, a loudspeaker, a sound processing device and a battery, characterized in that the device housing is at least partially bounded between the proximal side and the distal side by an outer casing comprising at least two opposite, at least substantially parallel, substantially flat casing parts for bounding a substantially block-shaped space therebetween, that the group of electronic components comprises a thickest component and a widest component, that a thickness of the substantially block-shaped space between the two casing parts is at least substantially equal to a thickness of the thickest component, and that a width of the substantially block-shaped space is at least substantially equal to a width of the widest component, wherein the sound processing device is arranged on a carrier provided on a main surface with at least one conductor track, that the sound processing device comprises an electronic port for data exchange, which port can be coupled at least via the at least one conductor track to a coupling connector of an external programming device, that the device housing comprises in the outer casing an opening which during use of the hearing aid in an auditory canal of a user leaves the at least one conductor track at least locally exposed, and that the coupling connector can be received at the position of the opening, wherein the at least one conductor track on the main surface of the carrier is in operative contact with a corresponding conductor track on the coupling connector, wherein the opening in the outer casing and a conductor track freely exposed behind the opening constitute the electronic port.

20. Hearing aid as claimed in claim 19, characterized in that the thickest and widest component is the battery which lies fittingly in a battery chamber, and that other components are situated fitting between the casing parts on one side of the battery chamber.

21. Hearing aid as claimed in claim 20, characterized in that the battery chamber lies on the proximal side of the device housing between the casing parts and that the other components are situated distally of the battery chamber between the casing parts.

22. Hearing aid as claimed in claim 19, characterized in that the device housing is at least substantially flat in a thickness direction, and that the outer casing is curved from the distal side to the proximal side in the thickness direction at an angle of between 10-20 degrees, in particular between 14-16 degrees.

23. Hearing aid as claimed in claim 22, characterized in that the casing parts curve from the distal side to the proximal side in the thickness direction at an angle of between 10-20 degrees, in particular between 14-16 degrees.

24. Hearing aid as claimed in claim 19, characterized in that the opening comprises a recess in the outer casing and that the carrier lies with an exposed part of the at least one conductor track in the recess.

25. Hearing aid as claimed in claim 19, characterized in that the opening comprises a gap in the outer casing behind which lies the carrier with the at least one conductor track, and that at least a part of the at least one conductor track is accessible by the coupling connector via the gap.

26. Hearing aid as claimed in claim 19, characterized in that the device housing is held in at least substantially fitting manner in a fitting body with a relatively flexible, limp outer wall able and adapted to adjust itself to a natural anatomy of an auditory canal of a user so as to lie close-fittingly therein.

27. Hearing aid as claimed in claim 26, characterized in that the fitting body connects at least substantially closely onto the device housing, and that at the position of the opening in the device housing there is a freely accessible space between the fitting body and the device housing for receiving the coupling connector therein in actively clamping manner.

28. Hearing aid as claimed in claim 26, characterized in that the fitting body comprises an engaging member extending beyond a proximal side of the device housing.

29. Hearing aid as claimed in claim 28, characterized in that at least the engaging member is provided with a guide for guiding the coupling connector of the external programming device to the opening of the device housing.

30. Hearing aid as claimed in claim 26, characterized in that the fitting body comprises in the outer wall thereof at least one continuous open ventilating channel which opens on a proximal side into a proximal ventilating opening and on a distal side into a distal ventilating opening, and that the device housing is arranged between the proximal ventilating opening and the distal ventilating opening in the fitting body.

31. Hearing aid as claimed in claim 30, characterized in that a relatively rigid tubular body is received in the at least one ventilating channel which is able and adapted to hold the ventilating channel open.

32. Hearing aid as claimed in claim 31, characterized in that one of the parts comprises the battery which is arranged movably inside a battery chamber, that one of the switch contacts makes contact with the battery and that in the compression state the battery makes contact with a further switch contact arranged against a wall of the battery chamber.

33. Hearing aid as claimed in claim 19, characterized in that the device housing comprises a control switch and at least two parts axially adjustable relative to each other, that between said parts are provided spring means which exert a bias between the two parts, that the parts are compressible counter to the bias from an initial state to a compression state, and that both parts are provided with switch contacts of the control switch which touch each other during a transition of the parts between the initial state and the compression state, whereby the control switch enters a changed switch mode.

34. Hearing aid as claimed in claim 19, wherein, the opening in the outer casing is formed by a groove in the outer casing, and the electronic port, via which the coupling connector, functionally couples to the sound processing device.

35. Hearing aid as claimed in 34, wherein, the device housing comprises coupling means which are able and adapted to couple the coupling connector with the corresponding conductor track releasably to the at least one conductor track of the carrier, the coupling connector fits in the groove such that the coupling connector is prevented from coming loose after coupling, and edges of the device housing define the groove and are operative as the coupling means to provide a releasable coupling of the connector to the conductor track of the carrier.

36. Hearing aid comprising a device housing which provides space for at least a control switch and a group of electronic components, the group comprising at least a loudspeaker, a microphone, a sound processing device, a programming connector, a battery and the control switch, characterized in that the device housing comprises at least two parts axially adjustable relative to each other, that between said parts are provided spring means which exert a bias between the two parts, that the parts are compressible counter to the bias from an initial state to a compression state, and that both parts are provided with switch contacts of the control switch which touch each other during a transition of the parts between the initial state and the compression state, whereby the control switch enters a changed switch mode, the sound processing device is arranged on a carrier provided on a main surface with at least one conductor track, that the sound processing device comprises an electronic port for data exchange, which port can be coupled at least via the at least one conductor track to a coupling connector of an external programming device, that the device housing comprises in an outer casing an opening which during use of the hearing aid in an auditory canal of a user leaves the at least one conductor track at least locally exposed, and that the coupling connector can be received at the position of the opening, wherein the at least one conductor track on the main surface of the carrier is in operative contact with a corresponding conductor track on the coupling connector, wherein the opening in the outer casing and a conductor track freely exposed behind the opening constitute the electronic port.

37. Hearing aid as claimed in claim 36, characterized in that one of the parts comprises the battery which is arranged movably inside a battery chamber, that one of the switch contacts makes contact with the battery and that in the compression state the battery makes contact with a further switch contact arranged against a wall of the battery chamber.

38. Hearing aid as claimed in claim 36, characterized in that the opening comprises a recess in the outer casing and that the carrier lies with an exposed part of the at least one conductor track in the recess.

39. Hearing aid as claimed in claim 36, characterized in that the opening comprises a gap in the outer casing behind which lies the carrier with the at least one conductor track, and that at least a part of the at least one conductor track is accessible by the coupling connector via the gap.

40. Hearing aid as claimed in claim 36, characterized in that the device housing is held in at least substantially fitting manner in a fitting body with a relatively flexible, limp outer wall able and adapted to adjust itself to a natural anatomy of an auditory canal of a user so as to lie close-fittingly therein.

41. Hearing aid as claimed in claim 40, characterized in that the fitting body connects at least substantially closely onto the device housing, and that at the position of the opening in the device housing there is a freely accessible space between the fitting body and the device housing for receiving the coupling connector therein in actively clamping manner.

42. Hearing aid as claimed in claim 40, characterized in that the fitting body comprises an engaging member extending beyond a proximal side of the device housing.

43. Hearing aid as claimed in claim 42, characterized in that at least the engaging member is provided with a guide for guiding the coupling connector of the external programming device to the opening of the device housing.

44. Hearing aid as claimed in claim 40, characterized in that the fitting body comprises in the outer wall thereof at least one continuous open ventilating channel which opens on a proximal side into a proximal ventilating opening and on a distal side into a distal ventilating opening, and that the device housing is arranged between the proximal ventilating opening and the distal ventilating opening in the fitting body.

45. Hearing aid as claimed in claim 44, characterized in that a relatively rigid tubular body is received in the at least one ventilating channel which is able and adapted to hold the ventilating channel open.

46. Hearing aid as claimed in claim 36, characterized in that the outer casing encloses between a proximal side and a distal side of the device housing a group of electronic components comprising at least a microphone, a loudspeaker, a battery and the sound processing device, that the outer casing comprises at least two opposite, at least substantially parallel, substantially flat casing parts for bounding a substantially block-shaped space therebetween, that the group of electronic components comprises a thickest component and a widest component, that a thickness of the block-shaped space between the two casing parts is at least substantially equal to a thickness of the thickest component, and that a width of the block-shaped space is at least substantially equal to a width of the widest component.

47. Hearing aid as claimed in claim 46, characterized in that the battery is the thickest and widest component and that the other components are situated fitting between the casing parts on one side of the battery.

48. Hearing aid as claimed in claim 47, characterized in that the battery lies on the proximal side of the device housing in a battery chamber between the casing parts and that the other components are situated distally of the battery chamber between the casing parts.

49. Hearing aid as claimed in claim 46, characterized in that the device housing is at least substantially flat in a thickness direction, and that the outer casing is curved from the distal side to the proximal side in the thickness direction at an angle of between 10-20 degrees, in particular between 14-16 degrees.

50. Hearing aid as claimed in claim 49, characterized in that the casing parts curve from the distal side to the proximal side in the thickness direction at an angle of between 10-20 degrees, in particular between 14-16 degrees.

51. Hearing aid as claimed in claim 36, wherein, the opening in the outer casing is formed by a groove in the outer casing, and the electronic port, via which the coupling connector, functionally couples to the sound processing device.

52. Hearing aid as claimed in 51, wherein, the device housing comprises coupling means which are able and adapted to couple the coupling connector with the corresponding conductor track releasably to the at least one conductor track of the carrier, the coupling connector fits in the groove such that the coupling connector is prevented from coming loose after coupling, and edges of the device housing define the groove and are operative as the coupling means to provide a releasable coupling of the connector to the conductor track of the carrier.

53. Hearing aid intended and adapted to be received at least substantially completely inside an auditory canal of a user in locally fitting manner, comprising a substantially rigid, form-retaining device housing in which at least one component is provided from a group of components, the group comprising a microphone, a loudspeaker, a sound processing device and a battery, wherein the device housing is held in at least substantially fitting manner in a fitting body with a relatively flexible, limp wall which is able and adapted to adjust itself to a natural anatomy of an auditory canal so as to lie close-fittingly therein, characterized in that the fitting body comprises in the wall thereof at least one continuous open ventilating channel which opens on a proximal side into a proximal ventilating opening and on a distal side into a distal ventilating opening, and that the device housing is arranged between the proximal ventilating opening and the distal ventilating opening in the fitting body, wherein the sound processing device is arranged on a carrier provided on a main surface with at least one conductor track, and which sound processing device comprises an electronic port for data exchange, which port can be coupled at least via the at least one conductor track to a coupling connector of an external programming device, that the device housing comprises in an outer casing an opening during use of the hearing aid in an auditory canal of a user which leaves the at least one conductor track at least locally exposed, and that the coupling connector can be received at the position of the opening, wherein the at least one conductor track on the main surface of the carrier is in operative contact with a corresponding conductor track on the coupling connector, wherein the opening in the outer casing and a conductor track freely exposed behind the opening constitute the electronic port.

54. Hearing aid as claimed in claim 53, characterized in that a relatively rigid tubular body is received in the ventilating channel.

55. Hearing aid as claimed in claim 53, characterized in that the opening comprises a recess in the outer casing and that the carrier lies with an exposed part of the at least one conductor track in the recess.

56. Hearing aid as claimed in claim 53, characterized in that the opening comprises a gap in the outer casing behind which lies the carrier with the at least one conductor track, and that at least a part of the at least one conductor track is accessible by the coupling connector via the gap.

57. Hearing aid as claimed in claim 53, characterized in that the fitting body connects at least substantially closely onto the device housing, and that at the position of the opening in the device housing there is a freely accessible space between the fitting body and the device housing for receiving the coupling connector therein in actively clamping manner.

58. Hearing aid as claimed in claim 53, characterized in that the fitting body comprises an engaging member extending beyond a proximal side of the device housing.

59. Hearing aid as claimed in claim 58, characterized in that at least the engaging member is provided with a guide for guiding the coupling connector of the external programming device to the opening of the device housing.

60. Hearing aid as claimed in claim 53, characterized in that an outer casing encloses the group of electronic components between a proximal side and a distal side of the device housing, that the outer casing comprises at least two opposite, at least substantially parallel, substantially flat casing parts for bounding a substantially block-shaped space therebetween, that the group of electronic components comprises a thickest component and a widest component, that a thickness of the block-shaped space between the two casing parts is at least substantially equal to a thickness of the thickest component, and that a width of the block-shaped space is at least substantially equal to a width of the widest component.

61. Hearing aid as claimed in claim 60, characterized in that the battery is the thickest and widest component and that the other components are situated fitting between the casing parts on one side of the battery.

62. Hearing aid as claimed in claim 61, characterized in that the battery lies on the proximal side of the device housing in a battery chamber between the casing parts and that the other components are situated distally of the battery chamber between the casing parts.

63. Hearing aid as claimed in claim 60, characterized in that the device housing is at least substantially flat in a thickness direction, and that the outer casing is curved from the distal side to the proximal side in the thickness direction at an angle of between 10-20 degrees, in particular between 14-16 degrees.

64. Hearing aid as claimed in claim 63, characterized in that the casing parts curve from the distal side to the proximal side in the thickness direction at an angle of between 10-20 degrees, in particular between 14-16 degrees.

65. Hearing aid as claimed in claim 53, characterized in that the device housing comprises a control switch and at least two parts axially adjustable relative to each other, that between said parts are provided spring means which exert a bias between the two parts, that the parts are compressible counter to the bias from an initial state to a compression state, and that both parts are provided with switch contacts of the control switch which touch each other during a transition of the parts between the initial state and the compression state, whereby the control switch enters a changed switch mode.

66. Hearing aid as claimed in claim 65, characterized in that one of the parts comprises the battery which is arranged movably inside a battery chamber, that one of the switch contacts makes contact with the battery and that in the compression state the battery makes contact with a further switch contact arranged against a wall of the battery chamber.

67. Hearing aid as claimed in claim 53, wherein, the opening in the outer casing is formed by a groove in the outer casing, and the electronic port, via which the coupling connector, functionally couples to the sound processing device.

68. Hearing aid as claimed in 67, wherein, the device housing comprises coupling means which are able and adapted to couple the coupling connector with the corresponding conductor track releasably to the at least one conductor track of the carrier, the coupling connector fits in the groove such that the coupling connector is prevented from coming loose after coupling, and edges of the device housing define the groove and are operative as the coupling means to provide a releasable coupling of the connector to the conductor track of the carrier.

* * * * *